US009877113B2

(12) United States Patent
Akino

(10) Patent No.: US 9,877,113 B2
(45) Date of Patent: Jan. 23, 2018

(54) CONDENSER MICROPHONE UNIT AND CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/251,551

(22) Filed: Aug. 30, 2016

(65) Prior Publication Data

US 2017/0180871 A1 Jun. 22, 2017

(30) Foreign Application Priority Data

Dec. 16, 2015 (JP) ..... 2015-244817

(51) Int. Cl.
*H04R 25/00* (2006.01)
*H04R 19/04* (2006.01)
*H04R 7/12* (2006.01)

(52) U.S. Cl.
CPC ..... *H04R 19/04* (2013.01); *H04R 7/122* (2013.01); *H04R 2307/025* (2013.01)

(58) Field of Classification Search
CPC ..... H04R 19/04
USPC ..... 381/174, 355, 356
See application file for complete search history.

(56) References Cited

U.S. PATENT DOCUMENTS 8,213,661 B2 * 7/2012 Hinke ..... H04R 19/04 381/174
8,848,962 B2 * 9/2014 Akino ..... H04R 19/04 381/356
8,975,107 B2 * 3/2015 Dehe ..... B81B 3/0072 257/415
2004/0005070 A1 * 1/2004 Kanda ..... H04R 19/04 381/369
2007/0025569 A1 2/2007 Akino
2009/0154753 A1 * 6/2009 Akino ..... H04R 9/08 381/355
2012/0237072 A1 * 9/2012 Akino ..... H04R 19/04 381/356
2017/0078787 A1 * 3/2017 Akino ..... H04R 19/04
2017/0171670 A1 * 6/2017 Akino ..... H04R 19/04

* cited by examiner

*Primary Examiner* — Davetta W Goins
*Assistant Examiner* — Phylesha Dabney
(74) *Attorney, Agent, or Firm* — Manabu Kanesaka

(57) ABSTRACT

A condenser microphone unit that has a capacitor element with a large effective area and a high signal-noise ratio but does not have frequency-dependence occurring with sound waves beyond the audio frequency range. A solid cylindrical fixed electrode pole is used as a fixed electrode. A diaphragm includes a rectangular synthetic resin film having a length smaller than or equal to the axis length of the fixed electrode pole, and a width equal to a circumferential length of the fixed electrode pole, the synthetic resin film including an electrode film on one face and ribs on the other face and entirely partitioned by the ribs into a plurality of diaphragm regions. The synthetic resin film is attached to an entire outer periphery of the fixed electrode pole such that the ribs are in contact with the outer periphery.

6 Claims, 4 Drawing Sheets

CONDENSER MICROPHONE UNIT AND CONDENSER MICROPHONE

RELATED APPLICATIONS

The present application is based on, and claims priority from, Japanese Application No. JP2015-244817 filed Dec. 16, 2015, the disclosure of which is hereby incorporated by reference herein in its entirety.

TECHNICAL FIELD

The present invention relates to a non-directional condenser microphone unit that is a high-resolution device capable of picking up sound waves beyond the audio frequency range.

BACKGROUND ART

There has recently been an increasing demand for an improvement in sound quality by picking up sound waves beyond the audio frequency range. According to "Hairezo-ryushon ohdio (saundo) no torikumi (efforts for high-resolution audio (sound))" released by the Japan Audio Society, a general incorporated association, on Jun. 12, 2014, a high-resolution device is defined as a device that has a recording microphone capable of performance in the high-frequency range of 40 kHz or more.

A hollow cylindrical condenser microphone having a diaphragm at one end generally suffers from diffraction effects resulting from its shape and thus cannot achieve such a performance unless the diameter of the hollow cylinder is made small. Measurement condenser microphones can pick up sound waves up to 100 kHz but have a ¼-inch diameter.

Such a small diameter offers a small effective capacitance between a diaphragm and a fixed electrode, which makes it difficult to ensure a signal-noise ratio (S/N ratio) required for picking up instrument sounds.

The invention disclosed in Patent Literature 1 (Japanese Patent Laid-Open No. 2004-282449) involves appropriate designs related to diffraction effects at the end of the hollow cylinder and the mechanical resonance frequency of a non-directional condenser microphone, so that the microphone ensures a signal-noise ratio required for picking up instrument sounds and picks up sound waves up to 100 kHz.

However, as shown in the graph of FIG. 6, the sound pressure detected at the end of the hollow cylinder is frequency-dependent on the diameter and wavelength of the microphone. Accordingly, increasing the diameter of a microphone for higher sensitivity decreases the frequency range it can pick up. It should be noted that the graph of FIG. 6 is cited from Non Patent Literature 1: FIG. 5-4 "Ento niyoru onpa no kaisekikouka (diffraction effects from sound waves produced by a hollow cylinder)" (Muller, Black, and Davis) in the article "Hosogijutsusha notameno maikurohon koza (5) keijo ya okisa ga oyobosu eikyo (learning of microphones for broadcasting engineers (5) Effects from shape and size)" by Jinichiro Nakamura, on Hosogijutsu in the October 1981 issue.

Patent Literature 2 (Japanese Patent Laid-Open No. 2007-36525) proposes a condenser microphone unit in which a fixed electrode is a solid cylindrical electrode and a hollow cylindrical diaphragm is engaged with the solid cylindrical electrode with a predetermined gap therebetween, thereby increasing the effective area and sensitivity of the capacitor element.

However, like a commonly-used condenser microphone, the condenser microphone unit according to Patent Literature 2 has openings on a bottom (an end facing a sound source) of a bottomed hollow cylindrical unit case in order to let sound waves in, thus receiving sound waves from the end surface intersecting the direction of the axis of the fixed electrode, i.e., the solid cylindrical electrode, and driving the hollow cylindrical diaphragm. This results in frequency-dependence occurring with sound waves beyond the audio frequency range.

Accordingly, an object of the present invention is to provide a high-resolution non-directional condenser microphone unit that has a capacitor element with a large effective area and a high signal-noise ratio but does not have frequency-dependence occurring with sound waves beyond the audio frequency range.

SUMMARY OF THE INVENTION

To achieve the above object, the present invention provides a non-directional condenser microphone unit with a diaphragm that serves as one electrode of a capacitor and a fixed electrode that serves as another electrode of the capacitor, the diaphragm and the fixed electrode facing each other with a predetermined gap between the diaphragm and the fixed electrode, including:

a solid or hollow cylindrical fixed electrode pole having a predetermined axis length, as the fixed electrode, in which the diaphragm includes a rectangular synthetic resin film having a length smaller than or equal to the axis length of the fixed electrode pole, and a width equal to a circumferential length of the fixed electrode pole, the synthetic resin film including an electrode film on one face and convex ribs on another face and entirely partitioned by the ribs into a plurality of diaphragm regions, and the diaphragm serving as a hollow cylindrical diaphragm electrode is attached to an entire outer periphery of the fixed electrode pole such that the ribs on the other face are in contact with the outer periphery of the fixed electrode pole.

In the present invention, the diaphragm regions preferably have the same shape and area.

Preferably, the diaphragm entirely has first convex-concave patterns each having a rough convex-concave profile with a long period, and second convex-concave patterns each present within the first convex-concave pattern and having a fine convex-concave profile with a short period. Convex portions of the first convex-concave patterns of this diaphragm can be used as the convex ribs.

In this case, the first convex-concave patterns are preferably hexagons making up a hexagonal pattern.

The present invention also includes a condenser microphone having a microphone case containing the above-described condenser microphone unit. This condenser microphone is a side-entry condenser microphone having openings in a sound pickup face corresponding to a face of the microphone case, the face intersecting an axis of the fixed electrode pole and facing the hollow cylindrical diaphragm electrode attached to the fixed electrode pole.

According to the present invention, a hollow cylindrical diaphragm electrode, serving as a diaphragm, is disposed along the outer periphery of a fixed electrode pole, serving as a fixed electrode, with convex ribs, serving as spacers, so that sealed spaces are formed for the respective diaphragm regions between the fixed electrode pole and the hollow cylindrical diaphragm electrode and each diaphragm region vibrates in response to the incoming sound waves. Each diaphragm region has a small area and a resonance frequency in a high-frequency range, resulting in a non-directional condenser microphone unit that gives no diffraction effects occurring with sound waves beyond the audio frequency range and that exhibits a high signal-noise ratio.

Since the condenser microphone unit has a sound pickup axis intersecting the axis of the fixed electrode pole and can pick up the incoming sound waves from all directions (360°) with the hollow cylindrical diaphragm electrode, the condenser microphone unit is used in a side-entry condenser microphone.

BRIEF DESCRIPTION THE DRAWINGS

FIG. 1 is a schematic break down perspective view of a condenser microphone according to an embodiment of the present invention;

FIG. 2*a* is a development view of a diaphragm before it is made cylindrical;

FIG. 2*b* is a plan view of the diaphragm which is a hollow cylindrical diaphragm electrode wrapped around the fixed electrode pole;

FIG. 3*a* is an enlarged view of part of the diaphragm;

FIG. 3*b* is a cross-sectional view along line A-A in FIG. 3*a;*

FIG. 3*c* is an enlarged cross-sectional view of part of a convex-concave pattern formed on the diaphragm;

DETAILED DESCRIPTION

Embodiments of the present invention will now be described with reference to FIGS. 1 to 5, although the present invention is not limited to the embodiments.

Figure 1:
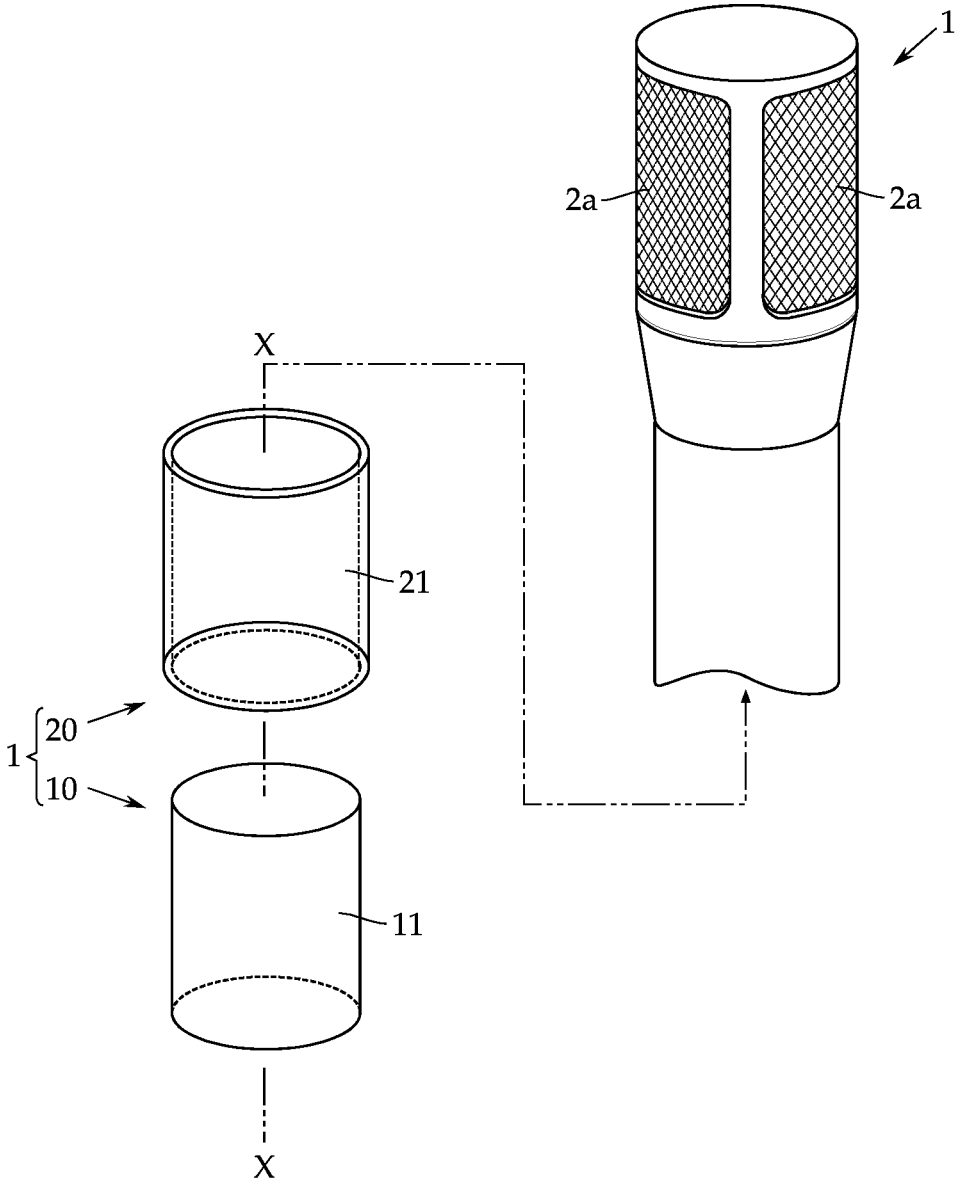

As shown in FIG. 1, a condenser microphone according to this embodiment basically includes a condenser microphone unit 1 and a microphone case 2 containing the condenser microphone unit 1.

Figure 6:
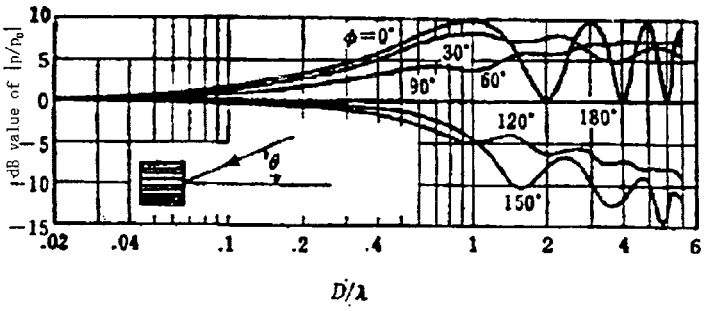
Fig.6 Prior Art
FIG. 6 is a graph showing diffraction effects from sound waves produced by a hollow cylinder.

Referring to "diffraction effects from sound waves produced by a hollow cylinder" shown in FIG. 6 that has been introduced as one of the background arts, in the case where the cylindrical body receives sound waves from 90° to the axis of the hollow cylinder, positioning a diaphragm at this direction eliminates the frequency-dependence occurring with sound waves beyond the audio frequency range regardless of an increase in signal-noise ratio achieved by an increase in the effective area of the capacitor element. The present invention has been made under these findings.

The condenser microphone unit 1 includes a fixed electrode 10 and a diaphragm 20. These two components form a variable capacitor with a capacitance that varies with the incoming sound waves. In this embodiment, the fixed electrode 10 is a fixed electrode pole 11 made of metal. The fixed electrode pole 11 may be either a solid cylinder or a hollow cylinder and may have an electret film attached to its outer periphery.

Figure 2A:
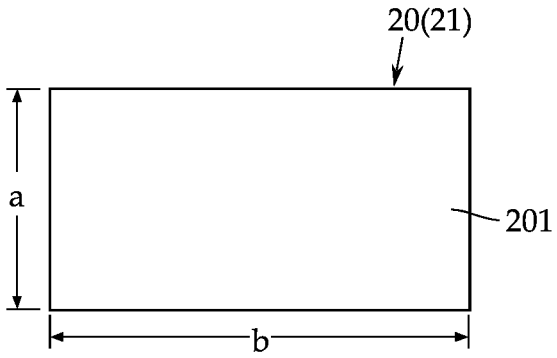

Accordingly, a hollow cylindrical diaphragm electrode 21 disposed around the fixed electrode pole 11 is used as the diaphragm 20. Referring to FIG. 2*a*, the diaphragm 20 consists of a rectangular synthetic resin film 201 having a length a smaller than or equal to the length of the axis of the fixed electrode pole 11 and a width b equal to the circumferential length of the fixed electrode pole 11.

Figure 2B:
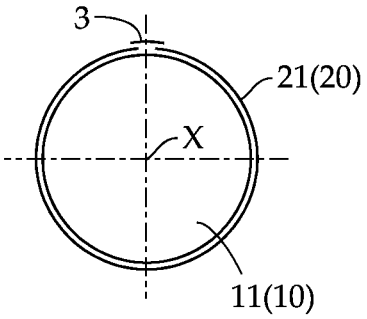

As shown in FIG. 2*b*, the synthetic resin film 201 is wrapped around the fixed electrode pole 11 and its ends are attached to each other with an adhesive tape 3, thereby completing the hollow cylindrical diaphragm electrode 21.

The synthetic resin film 201, which is a workpiece for the diaphragm, is preferably a polyphenylene sulfide (PPS) film having a thickness of, for example, about 2 μm. As shown in the circled enlarged cross-sectional view in FIG. 5, an electrode film 202 is, for example, an evaporated gold film on one face 201*a* of the synthetic resin film 201.

Figure 3A:
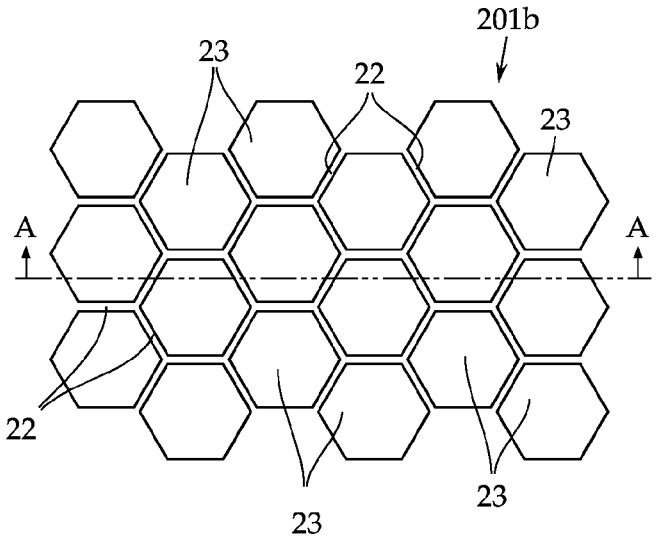
Figure 3B:
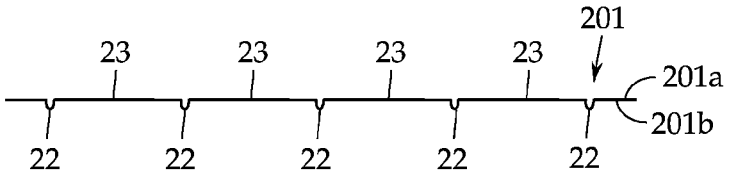

Referring to FIGS. 3*a* and 3*b*, the other face 201*b* of the synthetic resin film 201 has convex ribs 22 that partition (divide) the entire surface of the diaphragm 20 (the hollow cylindrical diaphragm electrode 21) into a plurality of small-area diaphragm regions 23.

These ribs 22 also function as spacers that ensure a predetermined gap between the fixed electrode pole 11 and the hollow cylindrical diaphragm electrode 21. As shown in FIG. 3*b*, the ribs 22 may be embossed such that they can be convex when seen from the other face 201*b* of the synthetic resin film 201 and concave when seen from the one face 201*a*.

The diaphragm regions 23 separated by the ribs 22 preferably have the same shape and area. Examples of the shape include a square, a rectangle, a rhombus, and a regular hexagon. The diaphragm regions 23 are preferably regular hexagons making up a hexagonal pattern which is resistant to distortion and other factors.

Alternatively, the present invention may use a diaphragm proposed in Japanese Patent Laid-Open No. 2009-290638 (Japanese Patent No. 5055203) (a diaphragm according to the previous application by the present applicant).

Figure 3C:
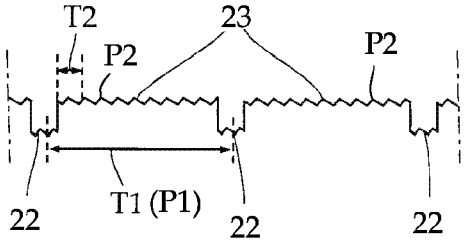

As shown in FIG. 3*c*, the diaphragm according to the previous application entirely has first convex-concave patterns P1 each having a rough convex-concave profile (with a large level difference) with a long period T1 and second convex-concave patterns P2 each present within the first convex-concave pattern P1 and having a fine convex-concave profile (with a small level difference) with a short period T2 (≤T1/10). Hence, in the present invention, convex portions of the first convex-concave patterns P1 can be used as the ribs (spacers) 22, and the second convex-concave patterns P2 can be used as the partitioned diaphragm regions 23 having small areas.

The diaphragm 20 (the synthetic resin film 201 with the electrode film 202) is wrapped around the fixed electrode pole 11 so that the ribs 22 on the other face 201*b* can be contact with the outer periphery of the fixed electrode pole 11, and its ends are attached to each other with the adhesive tape 3 (see FIG. 2*b*).

Figure 4:
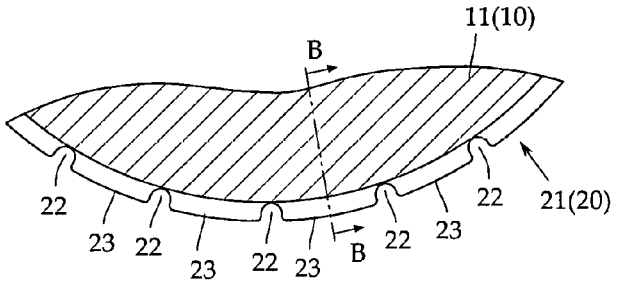
FIG. 4 is a cross-sectional view of part of the main part of the present invention.
Figure 5:
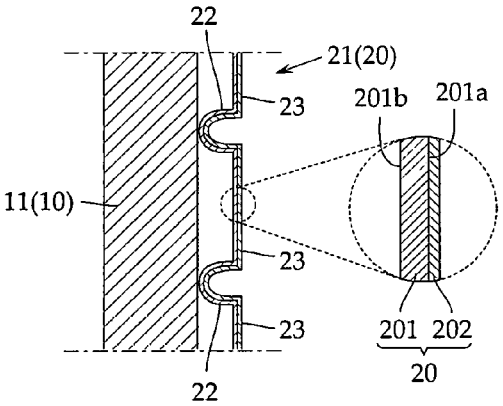
FIG. 5 is a cross-sectional view along line B-B in FIG. 4.

Thus, the hollow cylindrical diaphragm electrode 21 is disposed around the fixed electrode pole 11 in such a state that, as shown in FIGS. 4 and 5, sealed spaces are formed for the respective diaphragm regions 23 with the ribs 22 serving as spacers between the fixed electrode pole 11 and the hollow cylindrical diaphragm electrode 21.

To be specific, a plurality of capacitor elements forming, for example, hexagons (a hexagonal pattern) are regularly arranged around the fixed electrode pole 11 and individually vibrate in response to the incoming sound waves. It should be noted that sound signals are taken out of either the hollow cylindrical diaphragm electrode 21 side or the fixed electrode pole 11 side.

Since each diaphragm region (capacitor element) 23 has a small area and a resonance frequency in a high-frequency range, the condenser microphone unit is non-directional, gives no diffraction effects in response to sound waves beyond the audio frequency range, and has a high signal-noise ratio.

Referring again to FIG. 1, since the sound pickup axis of the condenser microphone unit 1 intersects the axis of the fixed electrode pole 11 and can pick up the incoming sound waves from all directions (360°) with the hollow cylindrical diaphragm electrode 21, the condenser microphone unit 1 is non-directional.

As shown in FIG. 1, the condenser microphone unit 1 in this embodiment, which is contained in the bottomed hollow cylindrical microphone case 2, can serve as a side-entry condenser microphone if a face of the microphone case 2 which intersects at least the axis of the fixed electrode pole 11 and faces the hollow cylindrical diaphragm electrode 21 attached to the fixed electrode pole 11 has openings so that that face can work as a sound pickup face 2*a*.

In this embodiment, the ribs 22 on the diaphragm 20 are used as spacers. In another embodiment, an electrically insulating net (with quadrangular, rhombic, or hexagonal openings) may be pre-attached to the outer periphery of the fixed electrode pole 11 and the diaphragm 20 (the synthetic resin film 201) may be wrapped around the outer periphery of the fixed electrode pole 11 with the net serving as a spacer.

The invention claimed is:

1. A non-directional condenser microphone unit comprising:

a diaphragm that serves as one electrode of a capacitor, and has a hollow cylindrical shape to be served as a hollow cylindrical diaphragm electrode; and a fixed electrode that serves as another electrode of the capacitor, and includes a solid or hollow cylindrical fixed electrode pole arranged inside the hollow cylindrical diaphragm electrode, the diaphragm and the fixed electrode facing each other with a predetermined gap between the diaphragm and the fixed electrode, wherein the solid or hollow cylindrical fixed electrode pole has a predetermined axis length, and the diaphragm is formed of a synthetic resin film having a length smaller than or equal to the axis length of the fixed electrode pole, and a width equal to a circumferential length of the fixed electrode pole, the synthetic resin film includes an electrode film on one face and convex ribs on another face, and is entirely partitioned by the ribs into a plurality of diaphragm regions, and the synthetic resin film is attached to an entire outer periphery of the fixed electrode pole such that the ribs on the another face are in contact with the outer periphery of the fixed electrode pole.

2. The condenser microphone unit according to claim 1, wherein the diaphragm entirely has first convex-concave patterns each having a rough convex-concave profile with a long period, and second convex-concave patterns each present within the first convex-concave pattern and having a fine convex-concave profile with a short period, and convex portions of the first convex-concave patterns correspond to the convex ribs.

3. The condenser microphone unit according to claim 2, wherein the first convex-concave patterns are hexagons making up a hexagonal pattern.

4. A condenser microphone comprising:

a microphone case containing the condenser microphone unit according to claim 1, the condenser microphone being a side-entry condenser microphone having openings in a sound pickup face corresponding to a face of the microphone case, the face intersecting an axis of the fixed electrode pole and facing the hollow cylindrical diaphragm electrode attached to the fixed electrode pole.

5. The condenser microphone unit according to claim 1, wherein the synthetic resin film has a rectangular shape to be formed in the hollow cylindrical shape.

6. A non-directional condenser microphone unit, comprising:

a diaphragm that serves as one electrode of a capacitor; and a fixed electrode that serves as another electrode of the capacitor, the diaphragm and the fixed electrode facing each other with a predetermined gap between the diaphragm and the fixed electrode, wherein the fixed electrode includes a solid or hollow cylindrical fixed electrode pole having a predetermined axis length, the diaphragm includes a rectangular synthetic resin film having a length smaller than or equal to the axis length of the fixed electrode pole, and a width equal to a circumferential length of the fixed electrode pole, the synthetic resin film including an electrode film on one face and convex ribs on another face and entirely partitioned by the ribs into a plurality of diaphragm regions, the diaphragm serving as a hollow cylindrical diaphragm electrode is attached to an entire outer periphery of the fixed electrode pole such that the ribs on the another face are in contact with the outer periphery of the fixed electrode pole, and the plurality of diaphragm regions has a shape and an area same as each other.

* * * * *